United States Patent [19]

Tran

[11] Patent Number: 5,000,347

[45] Date of Patent: Mar. 19, 1991

[54] METHOD FOR DISPENSING A PROTECTIVE FLUID

[76] Inventor: Anh T. H. Tran, 64 N. Tanglewood Dr., Clearwater, Fla. 34619

[21] Appl. No.: 383,599

[22] Filed: Jul. 24, 1989

[51] Int. Cl.[5] ..... B65D 83/14; F41C 9/00

[52] U.S. Cl. ..... 222/1; 222/153; 222/154; 222/336; 222/384; 222/402; 222/402.11; 42/1.08; 514/890

[58] Field of Search ..... 222/1, 153, 154, 158, 222/321, 336, 339, 383, 384, 385, 402, 402.11; 42/1.08; 514/890

[56] References Cited

U.S. PATENT DOCUMENTS

| | | | |
|---|---|---|---|
| 3,827,606 | 8/1974 | Knickerbocker | 222/402 |
| 3,920,164 | 11/1975 | Lindsoe | 222/321 X |
| 4,241,850 | 12/1980 | Speer | 222/39 |
| 4,371,097 | 2/1983 | O'Neill | 222/321 |
| 4,434,914 | 3/1984 | Meshberg | 222/402.13 X |
| 4,434,915 | 3/1984 | Kirk, Jr. | 222/321 X |
| 4,511,062 | 4/1985 | Wilkerson | 222/47 |
| 4,598,096 | 7/1986 | Grant | 514/890 X |
| 4,624,389 | 11/1986 | Ang | 222/78 X |

*Primary Examiner*—Andres Kashnikow
*Assistant Examiner*—Kenneth DeRosa
*Attorney, Agent, or Firm*—Leon Gilden

[57] ABSTRACT

A method for dispensing a protective fluid is set forth wherein a container is provided formed with a transparent storage portion threadedly receiving a cap thereto. The cap includes a lower end formed with a series of alignment bores for receiving tubular projections integrally formed coaxially upon an exterior surface of the portion of the cap to enable reciprocation of the upper portion relative to the lower portion. Positioning rods are positioned adjacent each of the bores to provide an abutment to enable effective alignment of the projections with the bores. The container is filled with a lemon juice concentrate, whereupon the container is prepared for transport by an individual. The upper portion of the cap may be rotated relative to the lower portion of the cap to permit reciprocation and projection of the lemon juice spray upon an attacker imposing oneself upon an individual.

2 Claims, 1 Drawing Sheet

Fig 1
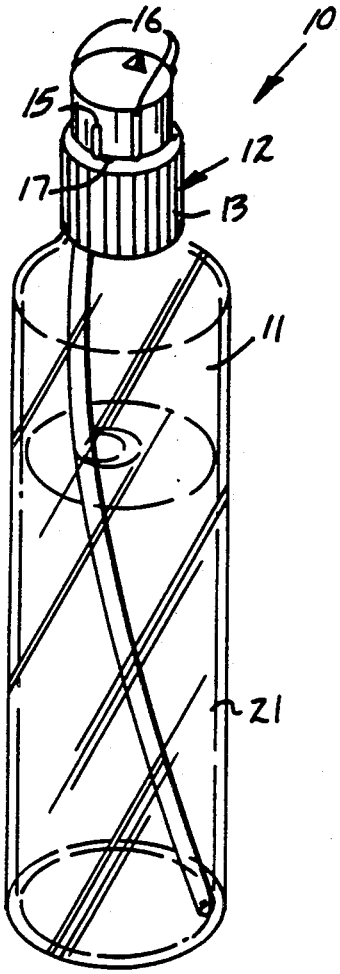
Fig 2
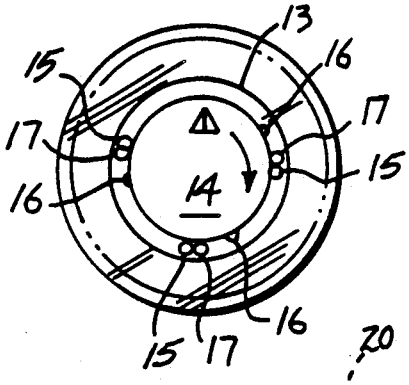
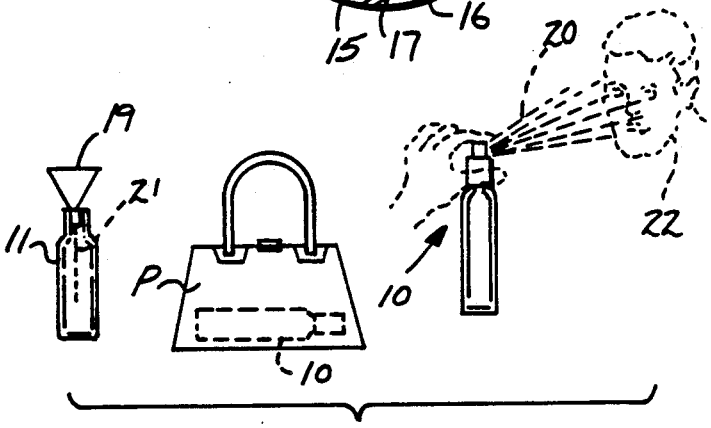
Fig 5
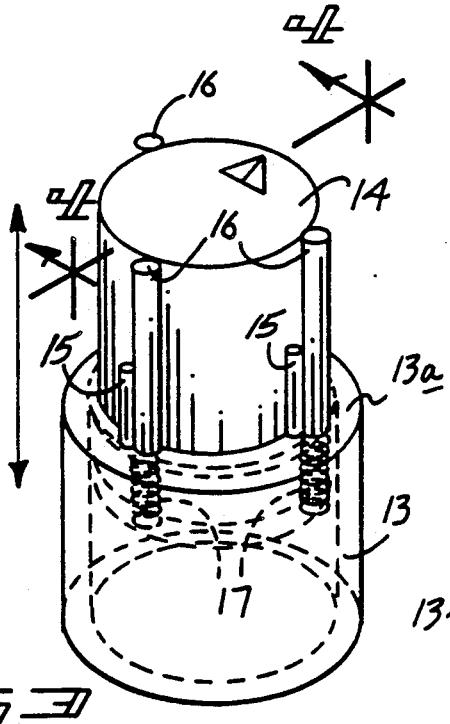
Fig 3
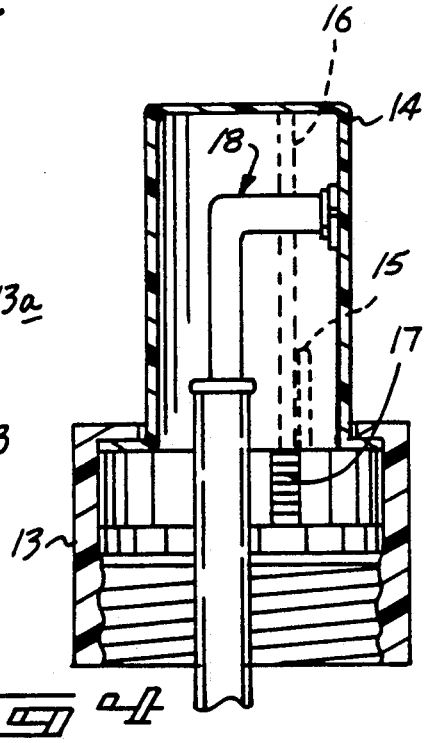
Fig 4

METHOD FOR DISPENSING A PROTECTIVE FLUID

BACKGROUND OF THE INVENTION

1. Field of the Invention

The field of invention relates to protective fluids, and more particularly pertains to a new and improved method for dispensing a protective fluid utilizing a lemon juice concentrate dispensed as a spray from a predetermined container.

2. Description of the Prior Art

The use of directing various sprays against an attacker for defensive purposes by individuals is known in the prior art. A majority of these sprays are particularly corrosive, whereupon error in use by an individual may result in financial and emotional problems assumed by the individual upon improper use of prior art sprays. Examples of the prior art apparatus and methods for applying sprays may be found in U.S. Pat. No. 4,402,430 to Fox, et al., for example. In this patent, a hand-held holder utilizes a pressurized container receivable within a frame member with a lever to effect directing of the pressurized container spray exteriorly for defensive purposes.

U.S. Pat. No. 4,034,497 to Yanda utilizes a self-defense device utilizing a charge of liquid therewithin wherein an explosive black powder mixture is arranged to heat an associated liquid for dispensing an alkaline metal, such as sodium, being admixed with a water when expelling is desired.

U.S. Pat. No. 4,449,474 to Mariol provides a safety device for personal security wherein an aerosol container is provided with a telescoping housing for receiving a gas canister therein containing a pressurized offensive odor. Additionally, the gas may contain the suspension of fine solid or liquid particles to provide permenent indication and marking of an attacker for subsequent identification.

U.S. Pat. No. 4,223,804 to Morris, et al., utilizes a self-defense device provided with a flashlight mechanism and a dispensing nozzle containing a quantity of defensive fluid therewithin.

U.S. Pat. No. 4,135,645 to Kimmel provides a self-defense ring with a movable member provided with a rupturing device to pierce a container contained within the ring having a chemical defensive substance therewithin.

As such, it may be appreciated that there is a continuing need for a new and improved method for dispensing a protective fluid which addresses both the problems of ease of use and effectiveness, and in this respect, the present invention substantially fulfills this need.

SUMMARY OF THE INVENTION

In view of the foregoing disadvantages inherent in the known types of protective fluid dispensing methods now present in the prior art, the present invention provides a method for dispensing a protective fluid utilizing undiluted citric lemon juice positioned within a dispensing container for subsquent dispensing of the fluid upon attack to an individual. As such, the general purpose of the present invention, which will be described subsequently in greater detail, is to provide a new and improved method for dispensing a protective fluid which has all the advantages of the proir art methods of dispensing protective fluids and none of the disadvantages.

To attain this, the present invention sets forth a method for dispensing a protective fluid including the step of providing a transparent container with a spray apparatus including an elongate tube directed interiorly of the container directed into a spray head. The spray head comprises a cap with a top portion and a bottom portion wherein the top portion is rotatably mounted relative to the bottom portion. The bottom portion includes a spaced series of bores and upwardly projecting positioning rods adjacent the bores, each spaced at 120 degrees relative to an upper surface of the lower portion. The upper portion is of a diameter less than that of the lower portion and includes positioning rods for reception within the bores to enable telescoping of the top portion relative to the bottom portion to permit dispensing of an undiluted lemon juice contained within the dispensing container. The container is filled with lemon juice and positioned within a purse or the like for transport by an individual with its withdrawal and rotation of the top portion of the cap relative to the bottom portion to permit directing of the lemon juice against an individual attacking, and particularly to direct the fluid at the individual's eyes to thwart such an attack.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invetion of the application, which is measured by the claims, nor is it intended to be limiting as to the scope of the invention in any way.

It is therefore an object of the present invention to provide a new and improved method for dispensing a protective fluid which has all the advantages of the prior art method for dispensing protective fluids and none of the disadvantages.

It is another object of the present invention to provide a new and improved method for dispensing a protective fluid which may be easily and efficiently manufactured and marketed.

It is a further object of the present invention to provide a new and improved method for dispensing a protective fluid which is of a durable and reliable construction.

An even further object of the present invention is to provide a new and improved method for dispensing a protective fluid which is susceptible of a low cost of manufacture with regard to both materials and labor, and which accordingly is then susceptible of low prices of sale to the consuming public, thereby making such methods for dispensing protective fluids economically available to the buying public.

Still yet another object of the present invention is to provide a new and improved method for dispensing a protective fluid which provides in the apparatuses and methods of the prior art some of the advantages thereof, while simultaneously overcoming some of the disadvantages normally associated therewith.

Still another object of the present invention is to provide a new and improved method for dispensing a protective fluid wherein an undiluted lemon juice is contained within a predetermined container for its dispensing in a spray form against an individual's eyes formulating an attack upon a user of the method.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the container utilized by the instant invention.

FIG. 2 is a top orthographic view of the dispensing cap of FIG. 1.

FIG. 3 is an isometric illustration of the dispensing cap of the instant invention.

FIG. 4 is an isometric illustration taken along the lines 4—4 of FIG. 3 in the direction indicated by the arrows.

FIG. 5 is a diagrammatic illustration of the method of filling, transporting, and dispensing the protective fluid utilized by the instant invention.

DESCRIPTION OF THE PREFERRED EMBODIMENT

With reference now to the drawings, and in particular to FIG. 1 to 5 thereof, a new and improved method for dispensing a protective fluid embodying the principles and concepts of the present invention and generally designated by the reference numeral 10 will be described.

More specifically, the method for dispensing a protective fluid essentially comprises providing a dispensing container 11 with a transparent storage lower container receptacle externally threadedly receiving a dispensing cap 12 thereon. The dispensing cap 12 includes an internally threaded lower first portion 13 of a cylindrical configuration rotatably mounting a second top portion 14, wherein the top portion 14 is of a second diameter less than that of a first diameter defined by the first portion 13. A planar ring ledge 13*a* is thereby defined as an upper surface of the first portion 13 spaced exteriorly of the second portion 14. A series of positioning rods 15 project orthogonally relative to the ring ledge 13*a* adjacent the second portion 14 and positioned adjacent alignment bores 17 directed orthogonally and below the surface defined by the ring ledge 13*a*. The bores 17 are positioned also in 120 degree spaced configuration for reception of the positioning rods 15 of cylindrical configuration and axially parallel to the axis of the top second portion 14, also spaced at 120 degrees positioning about the exterior side surface of the cylindrical second portion 14. Upon rotation of the second portion 14 relative to the bottom portion 13, the positioning rods 15 act as abutments upon where the tubular projections 16 contact to position the projections overlying the alignment bores 17 to enable reciprocation of the top portion 14 relative to the bottom portion 13 to effect dispensing of a spray through the spray assembly 18, including a pickup tube directed interiorly of an undiluted lemon juice fluid 21 positioned within the container receptacle 11. The alignment bores each are provided with a coil rebound spring therein whereupon telescopingly directing the upper second portion into the lower first portion, the rebound springs bias the first portion outwardly relative to the second portion. In use, the container receptacle 11 is filled with the undiluted lemon juice and the dispensing cap 12 mounted thereon. The receptacle and cap are thereby transported within a purse "P", or within a pocket by an individual utilizing the invention. In the event of need, the receptacle is quickly positioned for use by rotation of the top portion 14 relative to the bottom portion 13 to effect a spray of lemon juice 20 and an attacker 22.

The lemon juice provides no lasting disfigurement or harm to an attacker and with the directing of the spray against an attacker's eyes, the spray is extremely effective in thwarting continued assault.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method for dispensing a protective fluid comprising the steps of, providing a pump spray discharge container including a discharge nozzle, and further filling container with undiluted lemon juice, and positioning the container for access by an individual, and directing the nozzle at an attacker's eyes by the individual upon an assault by the attacker. and wherein the step of providing the container includes the further step of forming the container with a threadedly removable cap, and forming the cap with an internally threaded lower portion and a coaxially mounted second portion rotatably mounted overlying the first portion wherein the second portion is formed of a second diameter less than that defined by a first diameter of the first portion, and including the step of forming a series of bores within the lower portion spaced at 120 degrees relative to one another containing a rebound spring therein, the bores positioned adjacent the upper portion of the cap spaced below a top surface of the lower portion, and further including the step of providing a series of upwardly extending positioning rods orthogonally directed upwardly of the lower portion of the cap adjacent the bores, and further including the step of forming a series of tubular projections about an exterior side surface of the top portion whereupon rotation of the top portion relative to the bottom portion presents the projections in abutment with positioning rods and positions the projections overlying the bores.

2. A method for dispensing a protective fluid as set forth in claim 1 wherein the step of directing the nozzle at an attacker's eyes includes the step of rotatingly turning the top portion relative to the bottom portion to position the tubular projections overlying the alignment bores.

* * * * *